US009504899B2

(12) United States Patent
Rudow

(10) Patent No.: US 9,504,899 B2
(45) Date of Patent: Nov. 29, 2016

(54) UNDERGARMENTS FOR USE BY A HOCKEY PLAYER

(71) Applicant: Emily Rudow, Toronto (CA)

(72) Inventor: Emily Rudow, Toronto (CA)

( * ) Notice: Subject to any disclaimer, the term of this patent is extended or adjusted under 35 U.S.C. 154(b) by 34 days.

(21) Appl. No.: 14/182,990

(22) Filed: Feb. 18, 2014

(65) Prior Publication Data

US 2015/0231483 A1 Aug. 20, 2015

(51) Int. Cl.

| | |
|---|---|
| ***A63B 71/12*** | (2006.01) |
| *A41D 1/08* | (2006.01) |
| *A41D 13/05* | (2006.01) |

(52) U.S. Cl.

CPC ..... *A63B 71/1225* (2013.01); *A63B 71/1216* (2013.01); *A41D 1/08* (2013.01); *A41D 13/0543* (2013.01); *A63B 2071/1233* (2013.01); *A63B 2071/1241* (2013.01); *A63B 2071/1258* (2013.01); *A63B 2209/10* (2013.01)

(58) Field of Classification Search

CPC .... A41D 13/0543; A41D 1/067; A41D 1/08; A41D 1/06; A41D 17/02

USPC ..... 2/22, 23, 24, 79, 80, 227

See application file for complete search history.

(56) References Cited

U.S. PATENT DOCUMENTS

| | | | | | |
|---|---|---|---|---|---|
| 932,990 | A * | 8/1909 | Madill | A41D 1/067 | 2/227 |
| 2,355,193 | A * | 8/1944 | Walker | A41D 1/067 | 2/227 |
| 3,555,567 | A * | 1/1971 | Owen | 2/69.5 | |
| 3,670,339 | A * | 6/1972 | Cooper et al. | 2/22 | |
| 4,035,844 | A * | 7/1977 | Atack | A41D 1/08 | 2/22 |
| 4,091,466 | A * | 5/1978 | Kearn | A41D 13/015 | 2/227 |
| 4,325,148 | A * | 4/1982 | Livernois | A63B 71/12 | 2/22 |
| 4,384,369 | A * | 5/1983 | Prince | 2/79 | |
| 4,856,110 | A * | 8/1989 | Giesick | A41B 11/00 | 2/22 |
| 5,050,244 | A * | 9/1991 | Kleinman | A41D 1/067 | 2/227 |
| 5,105,473 | A * | 4/1992 | Valtakari | A41D 13/015 | 2/22 |
| 5,134,726 | A * | 8/1992 | Ross | A41D 1/08 | 2/22 |
| 5,377,693 | A * | 1/1995 | Loper et al. | 128/845 | |
| 5,539,926 | A * | 7/1996 | Mantos | A41D 1/08 | 2/228 |
| 5,649,328 | A * | 7/1997 | Martin | A41D 1/08 | 2/227 |
| 5,742,939 | A * | 4/1998 | Williams | 2/69 | |
| 5,826,273 | A * | 10/1998 | Eckes | 2/69 | |
| 6,745,400 | B1 * | 6/2004 | Paciorkowski | 2/69 | |
| 7,376,979 | B2 * | 5/2008 | Nilsen | A63B 21/065 | 2/69 |
| 8,146,176 | B2 * | 4/2012 | Rudolph | 2/227 | |
| 2003/0093852 | A1 * | 5/2003 | Webb | A41F 11/02 | 2/300 |
| 2005/0081277 | A1 * | 4/2005 | Matechen et al. | 2/102 | |
| 2007/0234467 | A1 * | 10/2007 | Leach et al. | 2/227 | |
| 2008/0125842 | A1 * | 5/2008 | Petitt | A41D 13/0012 | 607/108 |

(Continued)

FOREIGN PATENT DOCUMENTS

WO WO2012174523 * 12/2012

*Primary Examiner* — Andrew W Collins
*Assistant Examiner* — Brieanna Szafran
(74) *Attorney, Agent, or Firm* — Burris Law, PLLC

(57) ABSTRACT

An undergarment for use by a hockey player, the undergarment comprising a body portion configured to by snugly worn about the lower trunk area of the body and conforming to the contours thereof, a pair of leg portions extending from the body portion, each of said leg portions configured to surround one of the hockey player's legs, and impact absorbing pads connected to a back side of each of said legs portions to protect the back of the hockey player's legs.

18 Claims, 7 Drawing Sheets

(56) References Cited

U.S. PATENT DOCUMENTS

2009/0013451 A1* 1/2009 Baxter ..... A41B 9/001 2/455
2009/0320181 A1* 12/2009 MacGregor, Jr. ..... 2/231
2011/0131706 A1* 6/2011 Andersson ..... A41B 11/02 2/239
2012/0078147 A1* 3/2012 Ogulnick et al. ..... 602/2

* cited by examiner

UNDERGARMENTS FOR USE BY A HOCKEY PLAYER

FIELD OF THE INVENTION

The present invention relates to the field of protective sports equipment and in particular to an undergarment for use by a hockey player.

BACKGROUND OF THE INVENTION

Various types of protective equipment are worn by hockey players to protect them from body contact, hockey sticks, hockey pucks and hockey skates.

U.S. Pat. No. 6,782,559 to Regan discloses an undergarment for use by a hockey player comprising a one-piece torso portion having a head opening, leg openings and arm openings; a neck guard assembly comprising an integral neck guard coupled to the torso portion adjacent at the head opening, and a releasable attachment means coupled to the neck guard to permit the neck guard to be securely positioned on a neck of the player; a sock support positioned adjacent to each of the leg openings; an opening to permit the hockey player to don the undergarment; and a zipper positioned so that when closed the undergarment and the sock supports are retained in place on the hockey player.

It is an object to provide a novel hockey undergarment for use by a hockey player.

SUMMARY OF THE INVENTION

Accordingly, in one aspect there is provided an undergarment for use by a hockey player, the undergarment comprising a body portion configured to by snugly worn about the lower trunk area of the body and conforming to the contours thereof, a pair of leg portions extending from the body portion, each of said leg portions configured to surround one of the hockey player's legs, and impact absorbing pads connected to a back side of each of said legs portions to protect the back of the hockey player's legs.

According to another aspect there is provided an undergarment for use by a hockey player, the undergarment comprising a body portion configured to by snugly worn about the lower trunk area of the body and conforming to the contours thereof, a pair of leg portions extending from the body portion, each of said leg portions configured to surround one of the hockey player's legs, and a pair of shin pad sleeves, each of said shin pad sleeves connected to and circumferentiating a respective leg portion, said shin pad sleeves comprising a pocket configured to receive a bottom portion of a shin pad to allow the hockey player to selectively position a tongue of a hockey skate interior the shin pad or exterior the shin pad.

BRIEF DESCRIPTION OF THE DRAWINGS

Embodiments will now be described more fully with reference to the accompanying drawings in which.

DETAILED DESCRIPTION OF THE EMBODIMENTS

Figure 1:
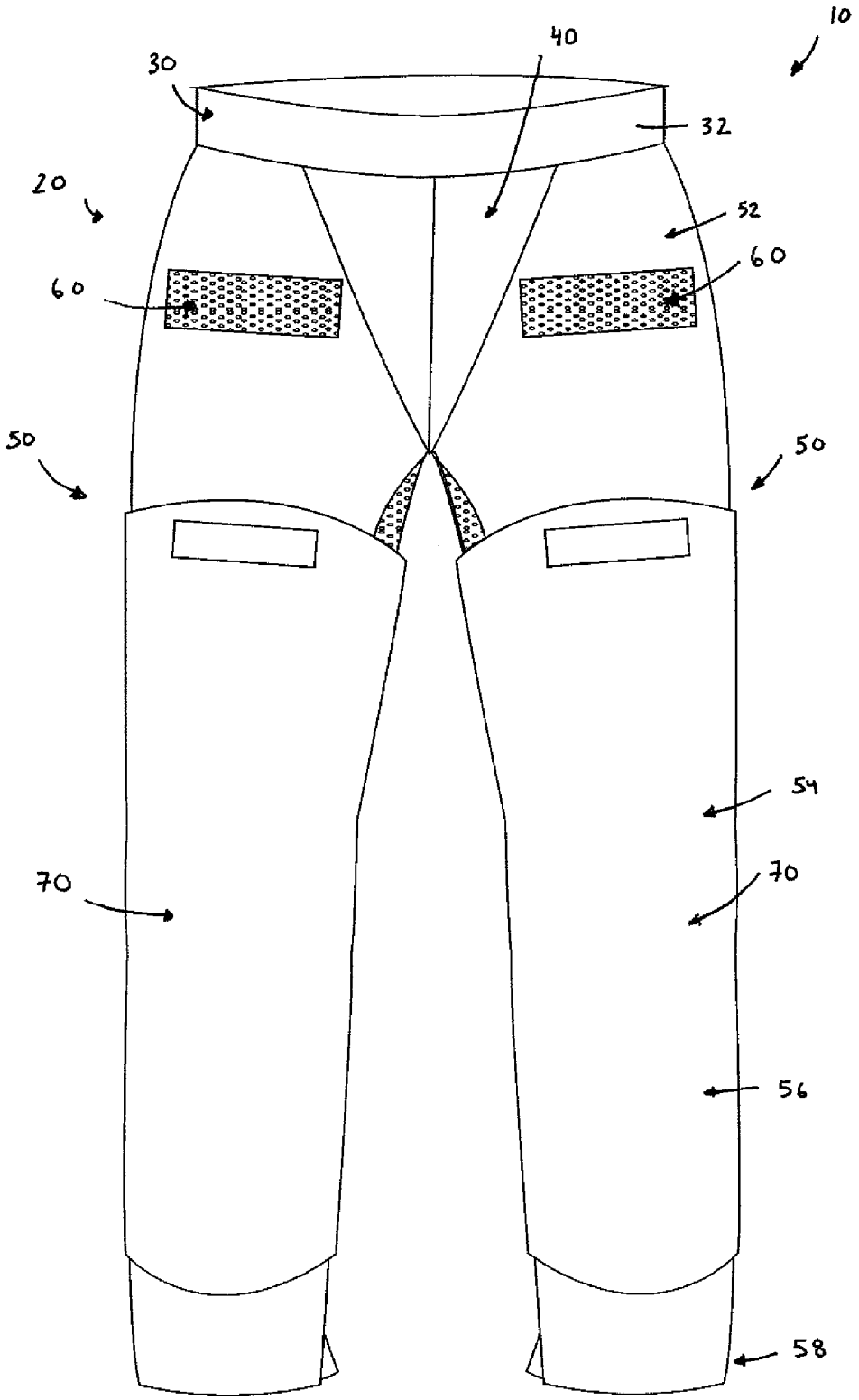
FIG. 1 is a front elevation view of an undergarment for use by a hockey player.
Figure 2:
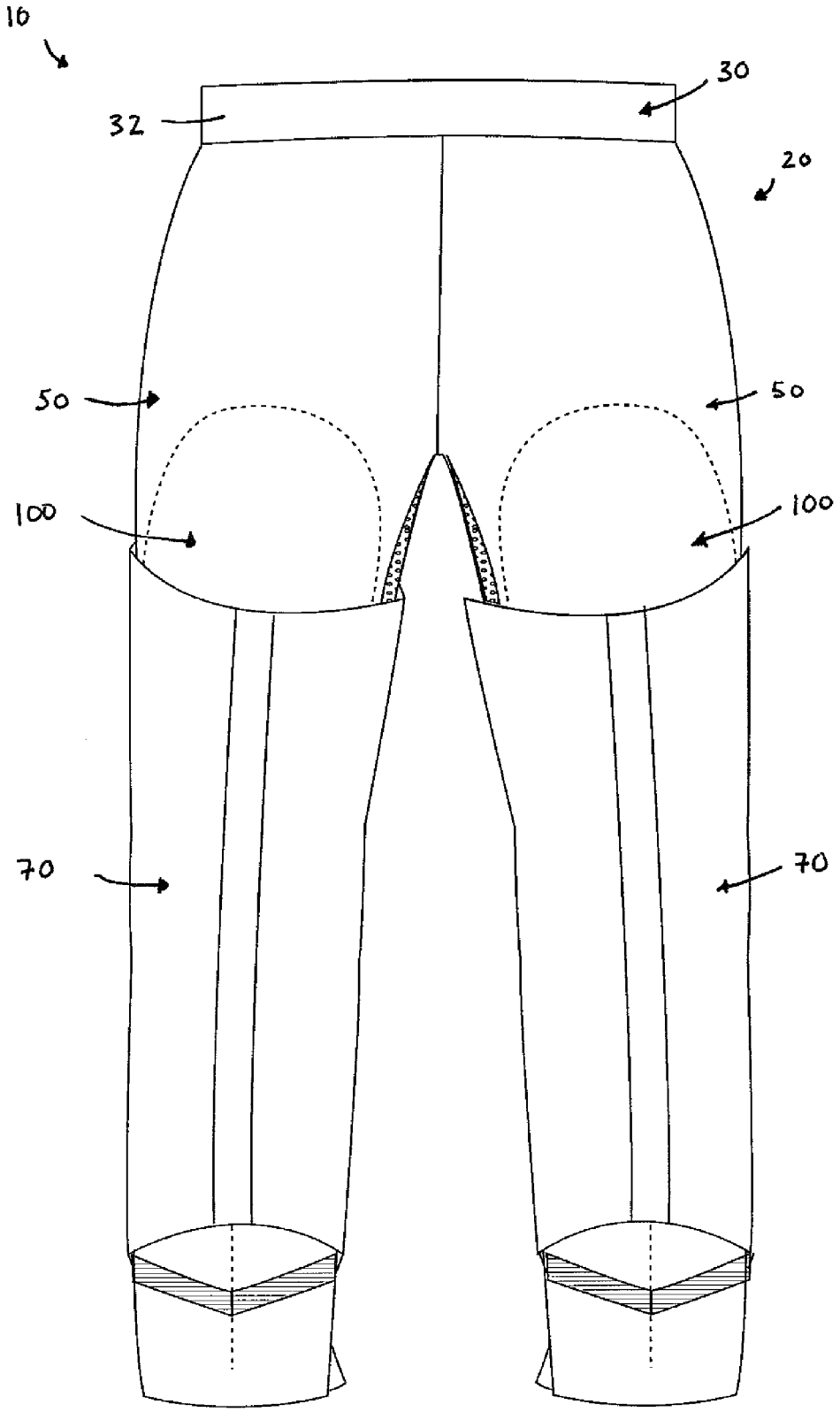
FIG. 2 is a rear elevation view of the undergarment of FIG. 1.

Turning now to FIGS. 1 and 2, an undergarment for use by a hockey player is shown and is generally identified by reference numeral 10. The undergarment 10 comprises a body 20 having a waist portion 30, a crotch portion 40 and a pair of leg portions 50, a sock support 60, a pair of shin pad sleeves 70, and impact absorbing pads 100. In this embodiment, all elements are made of a material comprising approximately 90% nylon and 10% spandex unless otherwise specified.

The waist portion 30 comprises an elastic waist band 32 dimensioned to snugly fit around the waist of the hockey player.

Figure 3:
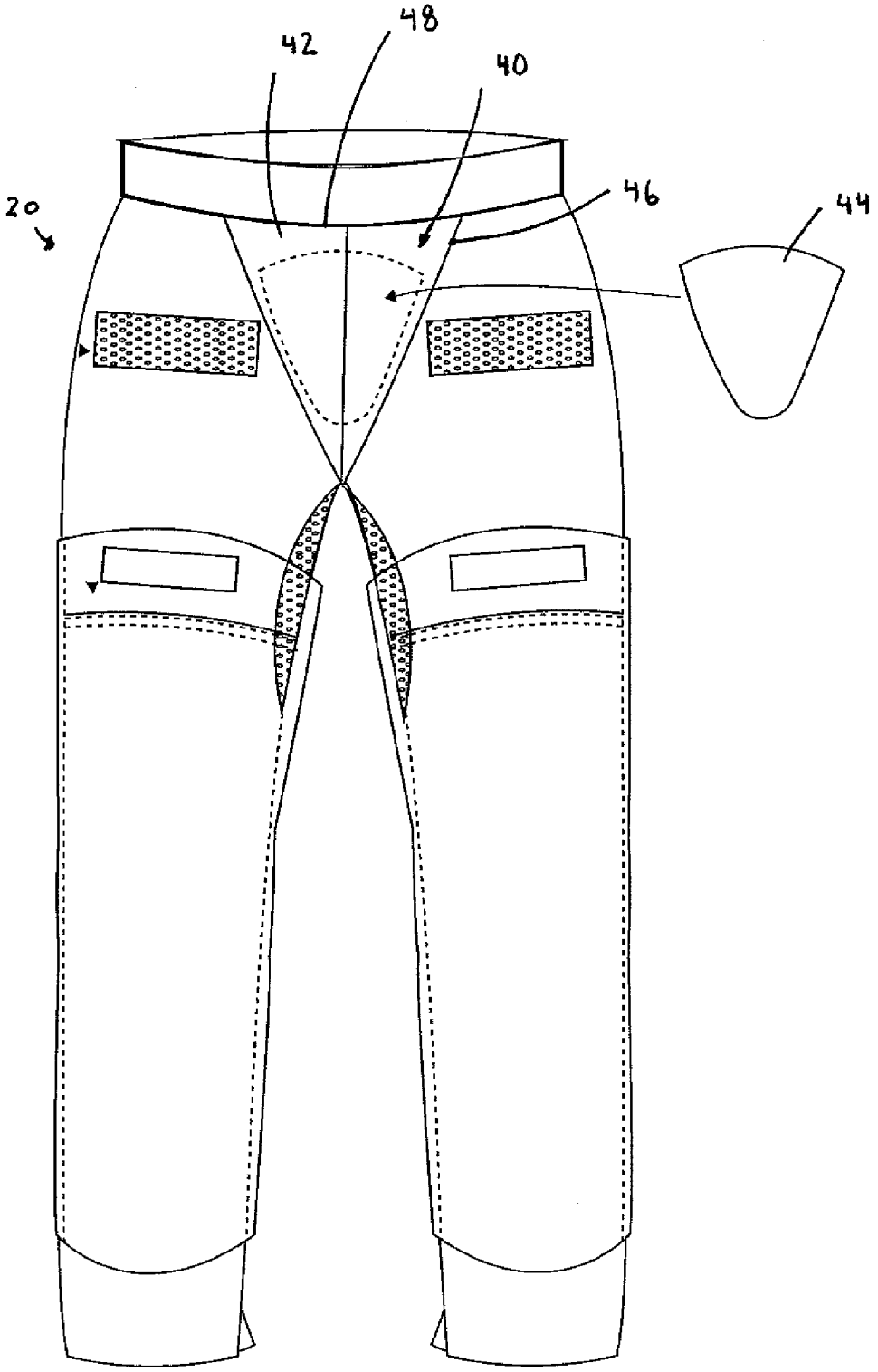
FIG. 3 is a front elevation view showing details of a crotch portion forming part of the undergarment of FIG. 1.

The crotch portion 40 is better shown in FIG. 3. As can be seen, the crotch portion 40 comprises a V-shaped pocket 42. The V-shaped pocket 42 is secured to the interior of the body 20 via stitching 46. The stitching 46 extends along each arm of the V-shaped pocket 42, thereby defining an opening 48 providing access to the V-shaped pocket 42. A genital protector 44 is received by the V-shaped pocket 42 through the opening 48. As will be appreciated, the type of genital protector 44 used is dependent on the gender of the hockey player. For male hockey players, a rigid, lightweight plastic genital protector (referred to as a "cup", "can" or "jock") shaped to cover and protect the male genitals is supported in the V-shaped pocket 42. For female hockey players, a padded protector (referred to as a "jill") shaped to cover and protect the female genitals is supported in the V-shaped pocket 42.

Turning back to FIGS. 1 and 2, each leg portion 50 extends from the waist portion 30 and is dimensioned to snugly fit around a respective leg of the hockey player. Each leg portion 50 comprises a thigh portion 52, a knee portion 54, a calf portion 56 and an ankle portion 58. In this embodiment, each leg portion 50 is made of a cut-resistant material such as for example a Kevlar™ material. It will be appreciated that in other embodiments only the ankle portion of the leg portions 50 may be made of a cut-resistant material.

Figure 4:
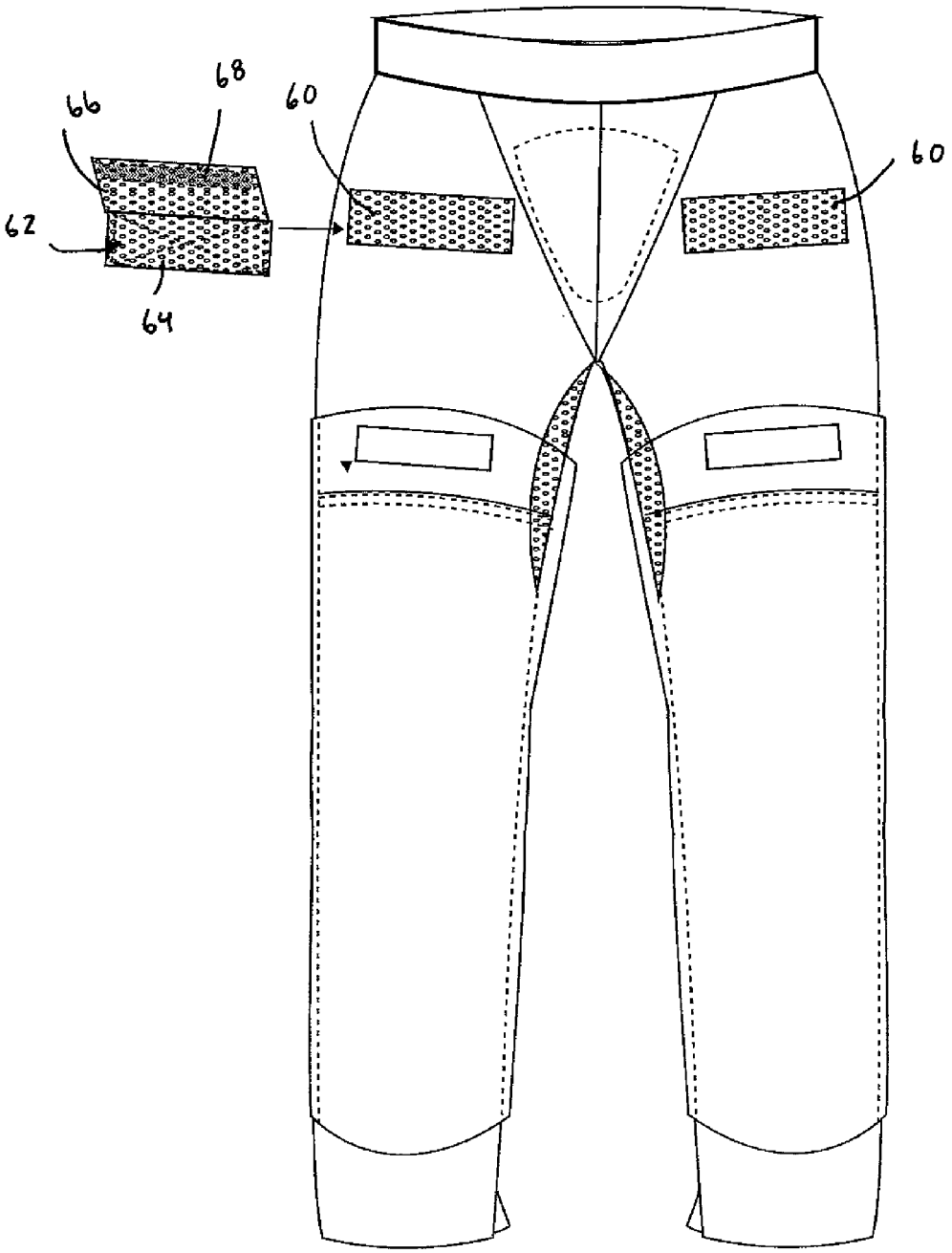
FIG. 4 is a front elevation view showing details of a sock support forming part of the undergarment of FIG. 1.

The sock support 60 is better shown in FIG. 4. As can be seen, the sock support 60 comprises a pair of support patches 62. Each support patch 62 comprises a pair of support members 64 and 66. The support member 64 is connected to a front portion of the leg portion 50 via stitching. The exterior portion of the support member 64 comprises a hook-type VELCRO™ material. The support member 66 is connected to the support member 64 along a top surface thereof. The interior portion of the support member 66 comprises a hook-type VELCRO™ material. A lip 68 extends along an edge of the support member 66 and comprises a loop-type VELCRO™ material. In this manner, the hook-type VELCRO™ material of the support members 64 and 66 is used to support the hockey player's hockey socks by grasping the fibers of the hockey sock, thereby preventing it from falling down. The loop-type VELCRO™ material of the support member 66 is used to mate with the hook-type VELCRO™ material of the support member 64, when no hockey sock is connected thereto.

Figure 5:
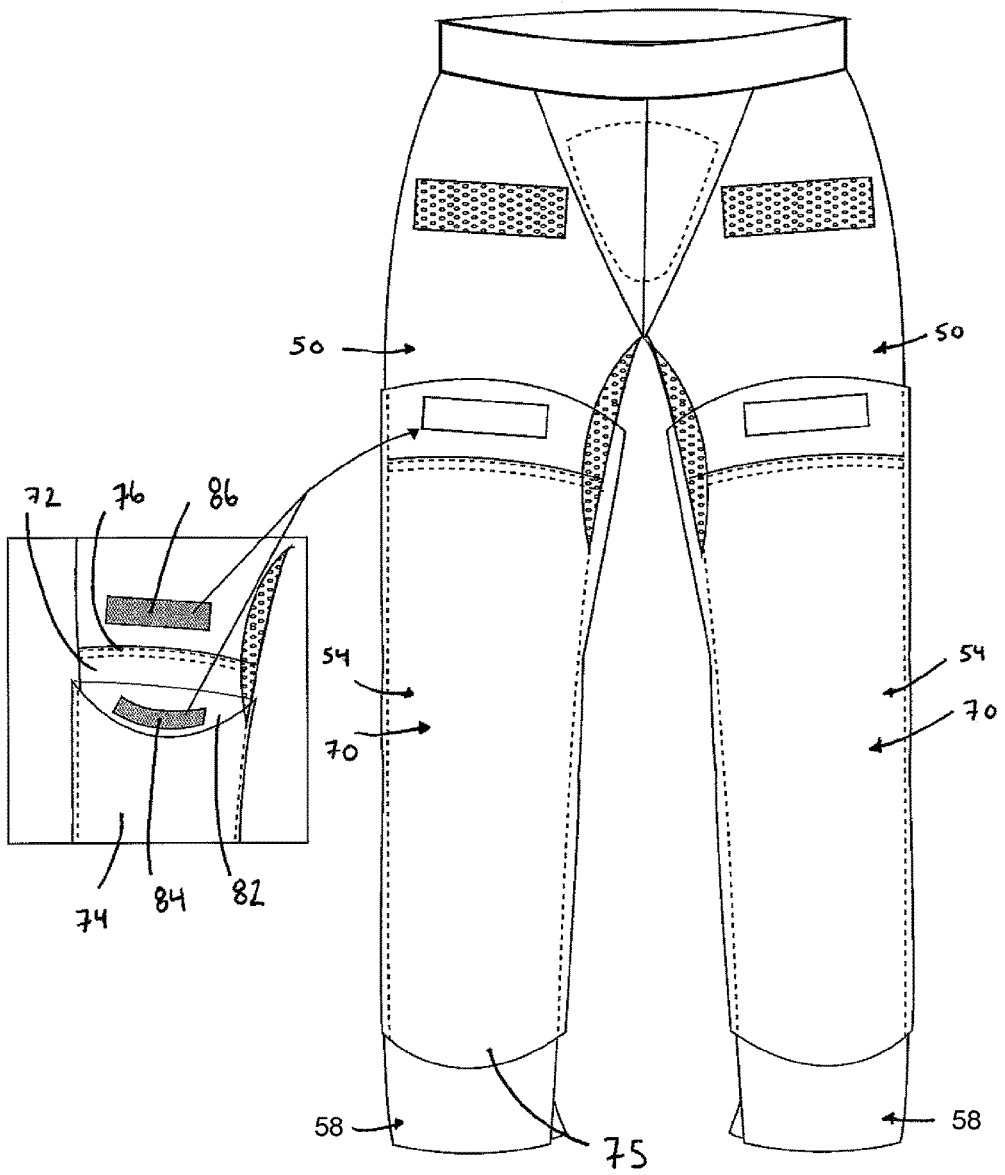
FIGS. 5 and 6 are front and rear elevation views, respectively, showing details of a pair of shin pad sleeves forming part of the undergarment of FIG. 1.
Figure 6:
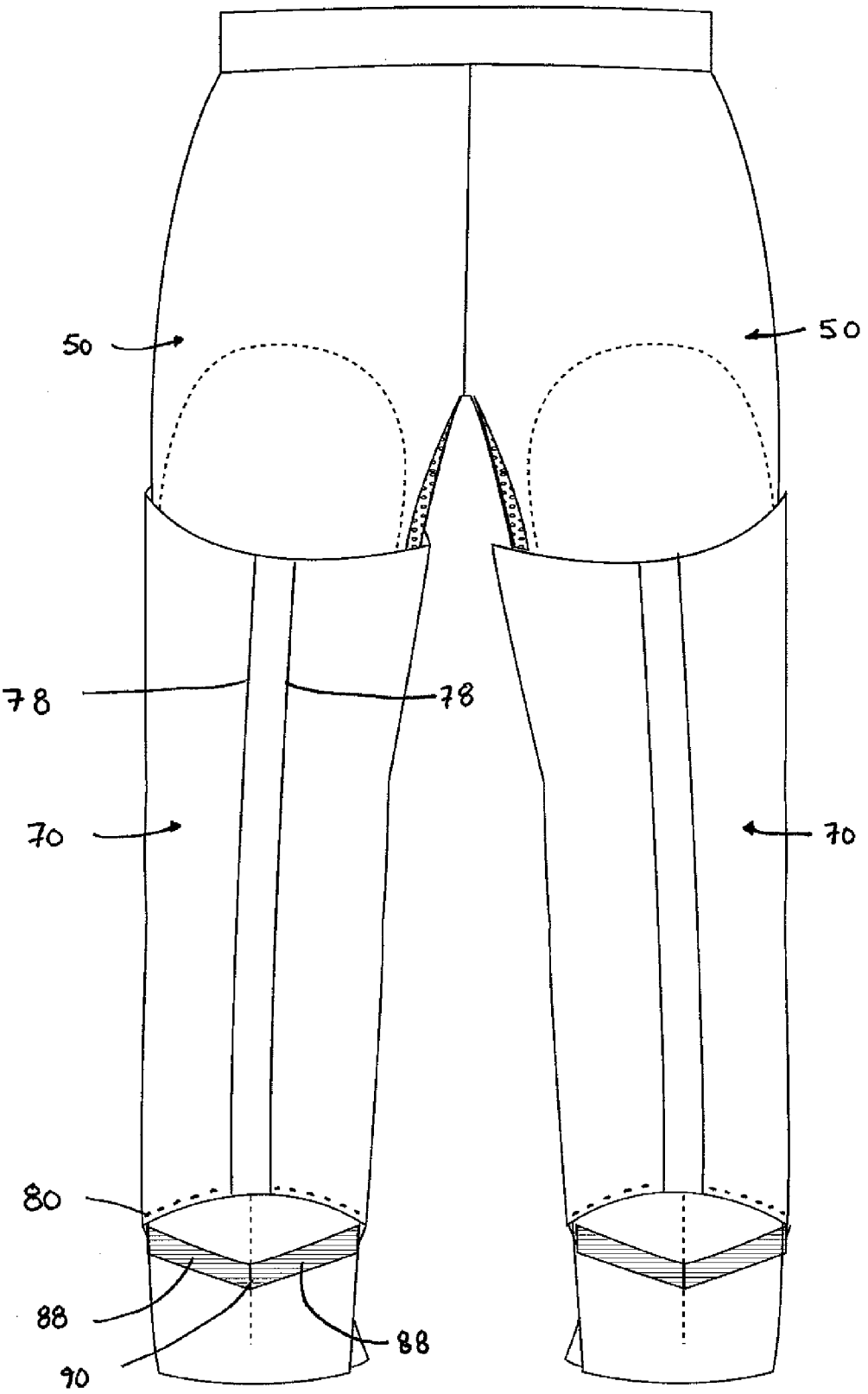

The shin pad sleeves 70 are better shown in FIGS. 5 and 6. As can be seen, each shin pad sleeve 70 is dimensioned to receive a shin pad and comprises inner material 72 and outer material 74. The inner material 72 is connected to the front of the leg portion 50 at a position above the knee portion 54 via stitching 76. The inner material 72 wraps around the leg portion 50 and is connected to the back of the leg portion 50 via stitching 78. As such, the inner material 72 radially circumferentiates the leg portion 50 and extends longitudinally from a position above the knee portion 54 to a position above the ankle portion 58. The outer material 74 overlaps the inner material 72 and is connected to the inner material 72 and the leg portion 50 via stitching 78. The outer material 74 is also connected to the inner material 72 along the bottom edge thereof via stitching 80. The outer material 74 extends above the top of the inner material 72 at the front portion, thereby defining a tab 82 for use as a fastening system. In this embodiment, the interior of the tab 82 comprises a hook-type VELCRO™ material patch 84. A loop-type VELCRO™ material patch 86 is connected to the front of the leg portion 50 above the top of the inner material 72. The loop-type VELCRO™ material patch 86 mates with the hook-type VELCRO™ material patch 84 when brought into contact therewith. The bottom front portion of the inner material 72 and the outer material 74 is U-shaped thereby forming a pocket 75 dimensioned to receive the bottom portion of the shin pad. The back bottom portion of the inner material 72 and the outer material 74 is inverse U-shaped, as shown in FIG. 6. Each side bottom portion of the inner material 72 and outer material 74, that is, the position where the U-shape and the inverse U-shape meet, is connected to a respective elastic 88. The elastic 88 extends from the side bottom portion of the inner material 72 and outer material 74 to the back of the ankle portion 58. The elastic 88 is connected to the back of the ankle portion 58 via stitching 90.

Figure 7:
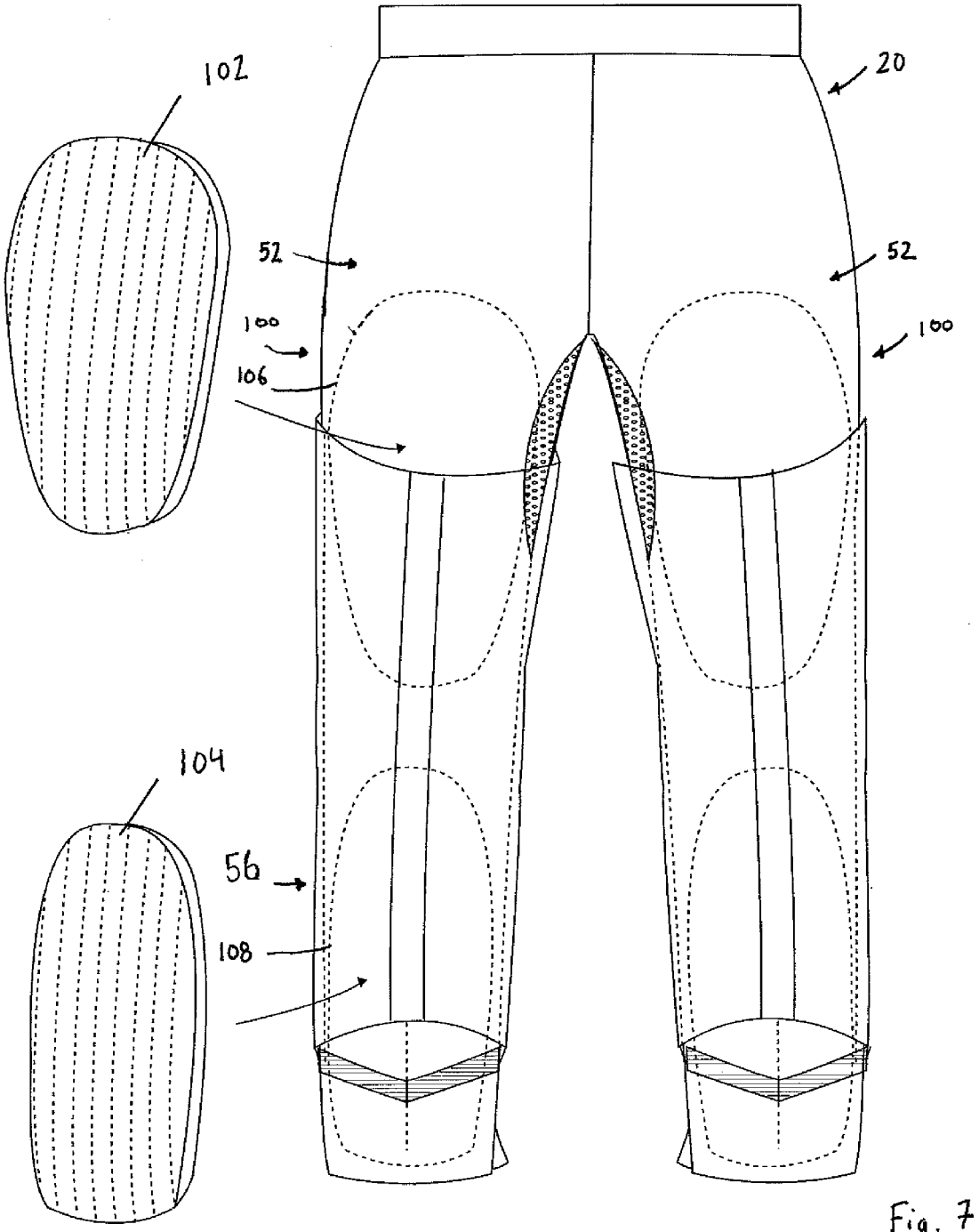
FIG. 7 is a rear elevation view showing details of impact absorbing pads forming part of the undergarment of FIG. 1.

The impact absorbing pads 100 are better shown in FIG. 7. As can be seen, the impact absorbing pads 100 comprise upper impact absorbing pads 102 and lower impact absorbing pads 104. In this embodiment, the upper impact absorbing pads 102 and lower impact absorbing pads 104 are made of a foam material such as for example polythene foam having a thickness of 1 cm to 5 cm. Each upper impact absorbing pad 102 is connected to the back of a respective thigh portion 52 via stitching 106. Each lower impact absorbing pad 104 is connected to the back of a respective calf portion 56 via stitching 108. As will be appreciated, the upper impact absorbing pads 102 and the lower impact absorbing pads 104 are connected to the back of the thigh portions 52 and the back of the calf portions 56 within the interior of the body 20.

During use, the hockey player puts on the undergarment 10 on, similar to putting on a pair of pants. In this embodiment, the genital protector 44 is already positioned in the V-shaped pocket 40 and thus the genital protector 44 is positioned in the proper place. The hockey player slides their shin pads into the shin pad sleeves 70 until a bottom portion of each shin pad is positioned in a respective pocket 75. The shin pads are secured in the shin pad sleeves using the loop-type VELCRO™ material patch 86 and the hook-type VELCRO™ material patch 84 positioned on the tab 82. The hockey player then slides their hockey socks over each shin pad, and secures their hockey socks to the undergarment 10 using the sock support 60. The hockey player slides their hockey pants over top of the undergarment 10. The hockey player then puts on and ties up their hockey skates. The hockey player can then pull each pocket 75 (which contains the bottom portion of a respective shin pad) to stretch out elastic 88, and can slide the tongue of each of their hockey skates underneath a respective pocket 75 (which contains the bottom portion of a respective shin pad). Alternatively, the hockey player can keep the tongue of each of their hockey skates exterior of a respective pocket 75 (which contains the bottom portion of a respective shin pad). The impact absorbing pads 100 protect the back of the hockey player's thighs and calves during use, thereby protecting the back of the hockey player's legs from hockey pucks, hockey sticks and hockey skates.

Although in embodiments described above the waist portion is described as comprising an elastic waist band, those skilled in the art will appreciate that variations are available. For example, in another embodiment the waist portion may comprise a draw-string type waist band, a zipper or a buckle.

Although in embodiments described above the shin pad sleeves are described as comprising a fastening system to allow the shin pads to be secured therein, those skilled in the art will appreciate that alternatives are available. For example, in another embodiment the shin pads may be sewn into the undergarment such that they are not readily removable therefrom.

Although in embodiments described above the undergarment is described as comprising shin pad sleeves, those skilled in the art will appreciate that alternatives are available. For example, in another embodiment the undergarment may not have the shin pad sleeves. In this embodiment, the hockey player's shin pads may be connected to the undergarment through use of one or more Velcro straps or disposable hockey tape.

Although in embodiments described above the shine pad sleeves are described as being attached to the leg portions via stitching, those skilled in the art will appreciate that alternatives are available. For example, in another embodiment the shin pad sleeves may be removably attached to the leg portions through use of a VECLRO™-type system or other suitable attachment devices such as for example snaps, a zippers, etc.

Although in embodiments described above the genital protector is described as being removable through an opening in the crotch portion, those skilled in the art will appreciate that alternatives are available. For example, in another embodiment the genital protector may be sewn into the crotch portion such that it is not readily removable therefrom. In another embodiment, the crotch portion may include a VELCRO™ type or other suitable type of fastening system to secure the genital protector therein.

In another embodiment, the shin pad sleeves may include slots to receive straps associated with the shin pads. In this embodiment, once the shin pads are inserted into the shin pad sleeves, the associated straps can be threaded through the slots to further secure the shin pads to the hockey player's legs.

Although in embodiments described above, the impact absorbing pads are described as being made of a foam material such as for example polythene foam having a thickness of 1 cm to 5 cm, those skilled in the art will appreciate that alternatives are available. For example, in another embodiment the impact absorbing pads may be made of a closed cell foam. In another embodiment, the impact absorbing pads may be made of a washable foam. In other embodiments, the impact absorbing pads may be made of a gel material, a rubber material or a silicon material.

Although in embodiments described above, the impact absorbing pads are described as comprising an upper impact absorbing pad and a lower impact absorbing pad, those skilled in the art will appreciate that alternatives are available. For example, in another embodiment only a lower impact absorbing pad may be used. In another embodiment, a plurality of small impact absorbing pads may be used and may be equally spaced along the back of the leg portion.

Although in embodiments described above, the impact absorbing pads are described as being sewn into the interior of the leg portions of the undergarment, those skilled in the art will appreciate that alternatives are available. For example, in another embodiment, the interior of the leg portions may have pockets sewn therein for receiving the impact absorbing pads. In this embodiment, the impact absorbing pads are inserted into the pockets for use, and can be removed when the undergarment is to be washed.

In another embodiment, the undergarment may be provided with patches made of a breathable material to increase the breathability of the undergarment during use.

Although in embodiments described above, all elements are described as being made of a material comprising approximately 90% nylon and 10% spandex unless otherwise specified, those skilled in the art will appreciate that alternative materials may be used. For example, in another embodiment the elements are made of elastane or a spandex mesh or other breathable material. In another embodiment these elements may be made of a combination of these materials.

Although in embodiments described above the sock support is described as comprising a VELCRO™-type system, those skilled in the art will appreciate that alternatives are available. For example, in another embodiment a garter-type system may be used.

Although in embodiments described above the shin pad sleeves are described as comprising tabs used as a fastening system, those skilled in the art will appreciate that alternatives are available. For example, in another embodiment elastic straps or bands may be used to retain the shin pads in the shin pad sleeves.

Although in embodiments described above the undergarment is described as comprising shin pad sleeves, those skilled in the art will appreciate that the undergarment does not require shin pad sleeves. For example, in the event that the hockey player is a goaltender, the undergarment does not require shin pad sleeves.

Although embodiments have been described above with reference to the accompanying drawings, those of skill in the art will appreciate that variations and modifications may be made without departing from the scope thereof as defined by the appended claims.

What is claimed is:

1. A protective undergarment comprising:

a waist portion comprising an elastic material and being dimensioned to be snugly worn about a waist of a body of a wearer;

a pair of leg portions comprising an elastic material and extending from the waist portion, each of said leg portions dimensioned to encircle a leg of the wearer's body;

impact absorbing pads connected to a back side of each of said leg portions configured to protect a back of the wearer's legs; and a pair of shin pad sleeves configured to extend over shins of the wearer, each shin pad sleeve comprising an inner material connected to and encircling a respective leg portion of the pair of leg portions and an outer material connected about a periphery of the inner material such that the outer material encircles the respective leg portion of the pair of leg portions thereby overlapping the inner material, wherein an opening is defined between the inner material and the outer material to receive a shin pad.

2. The protective undergarment of claim 1 wherein the impact absorbing pads comprise a lower pad configured to protect a calf portion of the wearer's legs.

3. The protective undergarment of claim 1 wherein the impact absorbing pads comprise an upper pad configured to protect a back of a thigh portion of the wearer's legs.

4. The protective undergarment of claim 1 comprising a sock support connected to each of said leg portions.

5. The protective undergarment of claim 4 wherein the sock support comprises at least one fastening member.

6. The protective undergarment of claim 5 wherein the at least one fastening member is one of a hook and loop and a garter-type hook.

7. The protective undergarment of claim 1 wherein each of the leg portions comprises an ankle portion comprising a cut-resistant material.

8. The protective undergarment of claim 7 wherein the cut resistant material is a para-aramid synthetic material.

9. A protective undergarment comprising:

a waist portion comprising an elastic material and dimensioned to be snugly worn about a waist of a body of a wearer;

a pair of leg portions comprising an elastic material and extending from the waist portion, each of said leg portions dimensioned to encircle a leg of the wearer's body; and a pair of shin pad sleeves, each of said shin pad sleeves connected to and encircling a respective leg portion, each shin pad sleeve comprising an inner material connected to and encircling a respective leg portion of the pair of leg portions and an outer material connected about a periphery of the inner material such that the outer material encircles the respective leg portion of the pair of leg portions thereby overlapping the inner material, wherein an opening is defined between the inner material and the outer material to receive a shin pad, wherein a bottom portion of each shin pad sleeve defines a pocket configured to receive a bottom portion of the shin pad to provide selective positioning of a tongue of a hockey skate interior underneath the shin pad or exterior over top of the shin pad.

10. The protective undergarment of claim 9 comprising at least two elastic bands, each of which is connected at a first end to said pocket of one of said shin pad sleeves and at a second end to a back of one of said leg portions.

11. The protective undergarment of claim 9 comprising impact absorbing pads connected to a back side of each of said legs portions configured to protect a back of the wearer's legs.

12. The protective undergarment of claim 11 wherein the impact absorbing pads comprise a lower pad configured to protect a calf portion of the wearer's legs.

13. The protective undergarment of claim 12 wherein the impact absorbing pads comprise an upper pad configured to protect a back of a thigh portion of the wearer's legs.

14. The protective undergarment of claim 9 comprising a sock support connected to each of said leg portions.

15. The protective undergarment of claim 14 wherein the sock support comprises at least one fastening member.

16. The protective undergarment of claim 15 wherein the at least one fastening member is one of a hook and loop and a garter-type hook.

17. The protective undergarment of claim 9 wherein each of the leg portions comprises an ankle portion comprising a cut-resistant material.

18. The protective undergarment of claim 17 wherein the cut resistant material is a para-aramid synthetic material.

* * * * *